US006650038B1

(12) United States Patent
Tulli et al.

(10) Patent No.: US 6,650,038 B1
(45) Date of Patent: Nov. 18, 2003

(54) CRT HAVING A TENSION MASK WITH REINFORCING SUPPORT MEANS

(76) Inventors: Carlo Tulli, Via G. A. Cesaro 39/8, IT-00137 Roma (IT); Paolo Ginesti, Via Fonte Meo 18, 00030 Gavignano (RM) (IT); Pedro Eugenio Cosma, Grande Muraglia 59, IT-00144 Roma (IT); Alessio Masi, Via Fontana Del Gatto, 52 IT-03023 Ceccano (IT)

( * ) Notice: Subject to any disclaimer, the term of this patent is extended or adjusted under 35 U.S.C. 154(b) by 0 days.

(21) Appl. No.: 10/166,302

(22) Filed: Jun. 10, 2002

(30) Foreign Application Priority Data

Jun. 22, 2001 (IT) ..... MI01A1319

(51) Int. Cl.[7] ..... H01J 29/80
(52) U.S. Cl. ..... 313/407; 313/402
(58) Field of Search ..... 313/402, 403, 313/404, 407

*Primary Examiner*—Vip Patel
(74) *Attorney, Agent, or Firm*—Joseph S. Tripoli; Joseph J. Laks; Carlos M. Herrera

(57) ABSTRACT

Cathode-ray tube (1) comprising a frame/mask assembly for selecting colors having a mask (8) and a frame (19), the mask being held under tension by being attached to ends of long sides (9) of the frame, the frame/mask assembly being suspended inside the tube using support means (10) which are able to increase the mechanical rigidity of the frame by support means having longitudinal dimples (40) which cause the long sides of the frame to come together during the high-temperature manufacturing phases.

7 Claims, 3 Drawing Sheets

CRT HAVING A TENSION MASK WITH REINFORCING SUPPORT MEANS

FIELD OF INVENTION

The invention relates to a color cathode-ray tube (CRT) and more particularly to the frame/mask device for selecting colors placed inside the glass envelope of the tube. The invention is applicable to any type of tube comprising a color selection mask and is more particularly suited to tubes whose mask is held under tension by the frame to which it is fastened.

BACKGROUND OF THE INVENTION

Conventional cathode-ray tubes comprise a color selection mask located at a precise distance from the inside of the glass front face of the tube, on which front face red, green and blue phosphor arrays are deposited. Color CRTs generally have three electron beams, each one corresponding to a particular primary color phosphor array. The mask makes it possible for each particular beam to illuminate only the phosphor of the corresponding color.

During operation of the tube, the color selection mask must be placed and held in a precise position inside the tube. The function of holding the mask is carried out by means of a generally rigid rectangular metal frame, to which the mask is welded. The frame/mask assembly is mounted in the front face of the tube by a suspension means which includes a spring having an aperture. The aperture is designed to engage with one of the metal pins included in the glass front face. Generally tubes manufactures have the support means either on the sides of the mask frame or at the corners of the frame.

The current trend in the CRT industry is toward increasingly flat front faces. To produce tubes, manufactures have designed mask having flatter contours. The meet the demand for flatter mask contours the some designers have designed uniaxial tension masks. Such structures are described, for example, in U.S. Pat. No. 5,111,107. To keep the mask flat, high tension must be applied. The high tension requirement has forced designers to construct relatively heavy frame structures which consumes much material. As such, there is a need in the industry to develop lighter structures that can also effective hold a mask under tension.

SUMMARY OF THE INVENTION

The invention is for a CRT that comprises a tension mask having light frame structure. The light frame structure is realized reinforcing means for the frame/mask system. The CRT according to the invention also includes a glass front face on which a phosphor screen is deposited, a color selection mask placed close to the screen, a frame to which the mask is attached and which holds the mask under tension in at least one direction, the frame being of substantially rectangular shape defined by a pair of opposed long side and a pair of opposed short sides. At least two opposed sides each comprise an edge in the form of a metal plate substantially parallel to the surface of the mask. The frame/mask assembly is held inside the front face by reinforcing means cooperating with pins inserted in the sidewalls of the front face. The CRT is further characterized by reinforcing means having a metal plate fastened to at least one of the sides, close to the corners of the frame, wherein the plates comprise a longitudinal dimple lying at least partially in the direction of tension of the mask.

BRIEF DESCRIPTION OF THE DRAWINGS

The invention will be better understood with the help of the description below and the following figures.

DETAILED DESCRIPTION OF THE INVENTION

Figure 6:
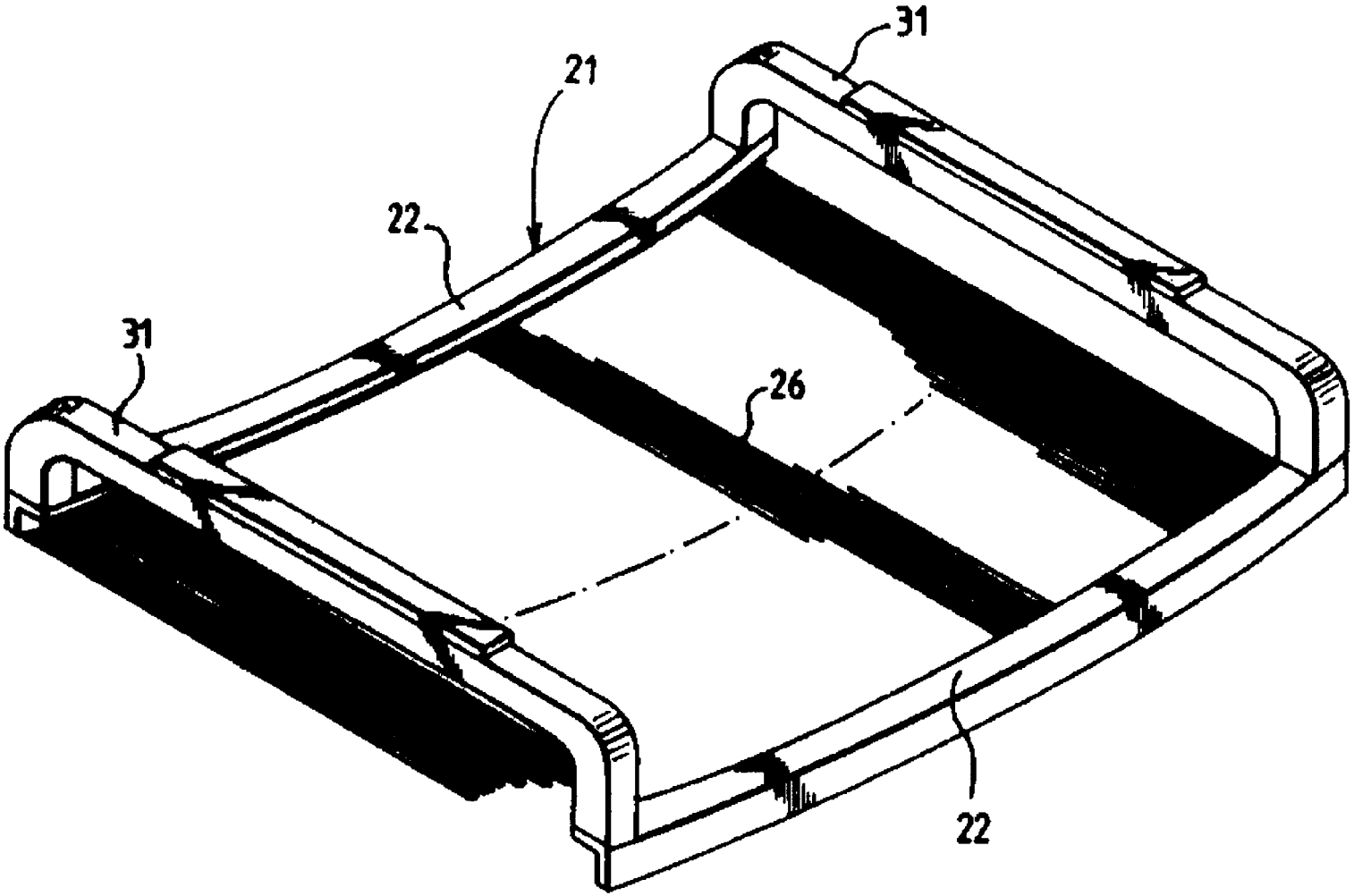
FIG. 6 is a frame/mask assembly according to the state of the art, seen in perspective view.

Conventional tensions masks 26 as seen in FIG. 6 comprise two long sides 22 to which the mask is welded and U-shaped short sides 31. The short sides must maintain the mask in tension during the tube manufacturing phases and during normal operation. In order to maintain this tension, the frame must have large fairly massive profiles, which leads to two major drawbacks:

(1) a large weight which is especially appreciable for tubes with a large screen size (i.e. tubes having a diagonal greater than 70 cm) and (2) large consumption of material which considerably affects the overall cost of the tube particularly if the frame is manufactured from an expensive material such as Invar, which is used minimize the thermal expansion phenomena.

Figure 1:
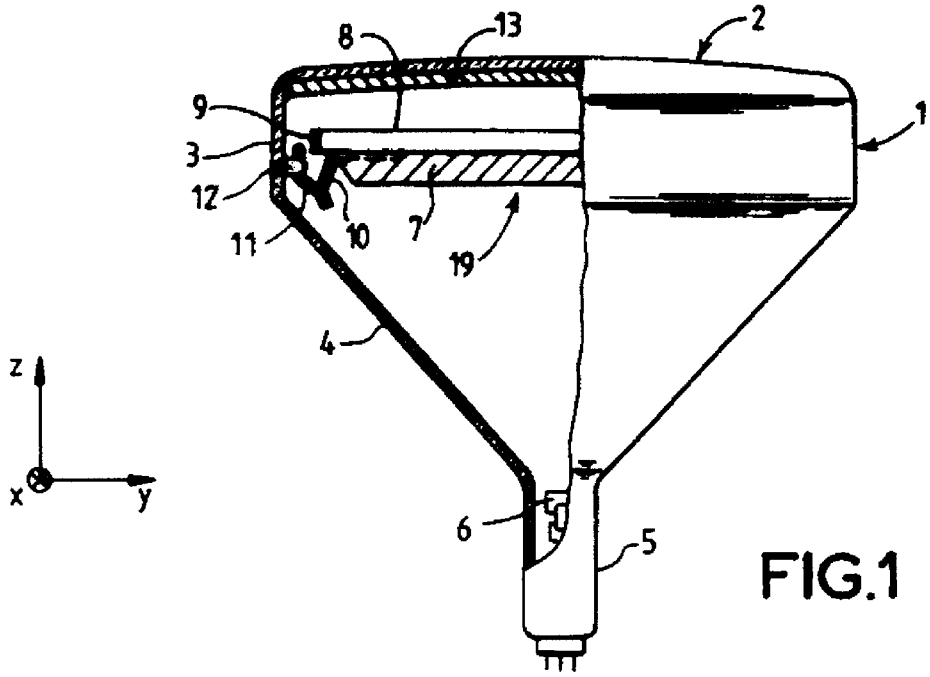
FIG. 1 shows a cathode-ray tube according to the invention seen partially exploded.

The CRT according to the present invention avoids the above-mentioned drawback while providing adequate tension to the mask. As illustrated in FIG. 1, a cathode-ray tube 1 according to the invention comprises a substantially flat panel 2 and a peripheral skirt 3. The panel 2 is connected to the funnel 4 of the tube 1 by means of a sintered glass seal. The neck 5 of the tube 1 surrounds the electron gun 6, whose generates electron beams to illuminate the phosphor screen 13 through the color selection mask 8, which in this case is flat and held taut between the long sides 9 of the frame 19. Metal supports for the frame/mask assembly hold this assembly inside the tube. The supports can include a support part 10 welded to the frame 19 and a spring 1. The spring 11 has an aperture which fits onto a pin 12, which is attached to the skirt 3.

Figure 4:
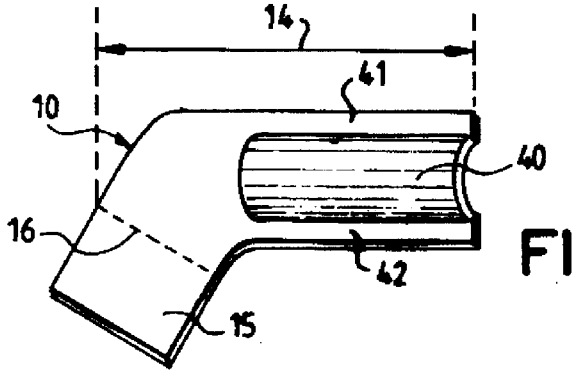
FIG. 4 shows in detail a frame/mask support according to the invention.
Figure 2:
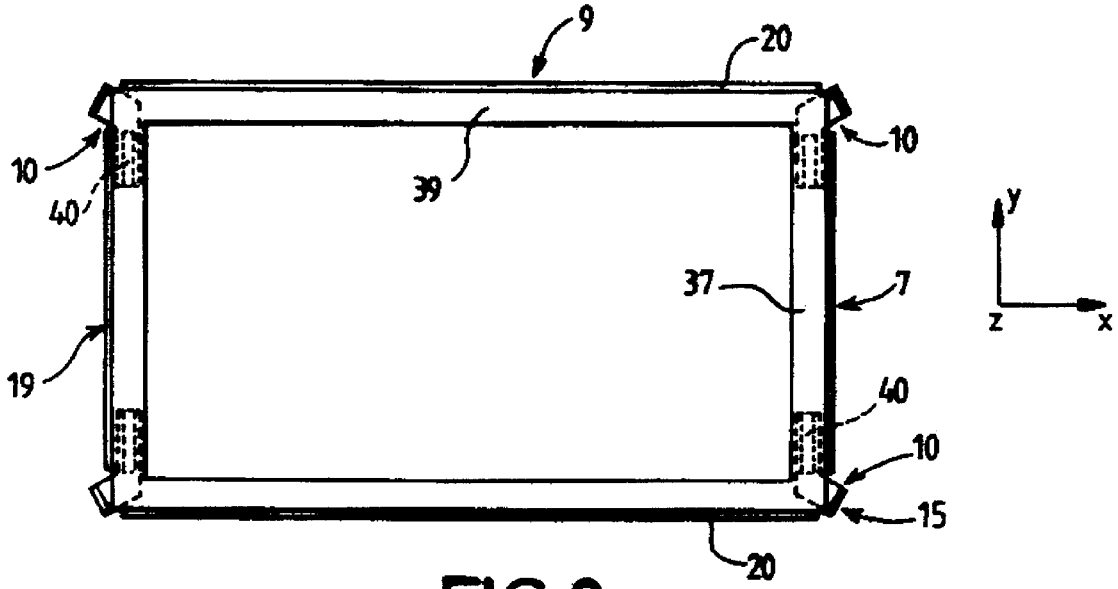
FIG. 2 shows a top view of the frame according to the invention.
Figure 3:
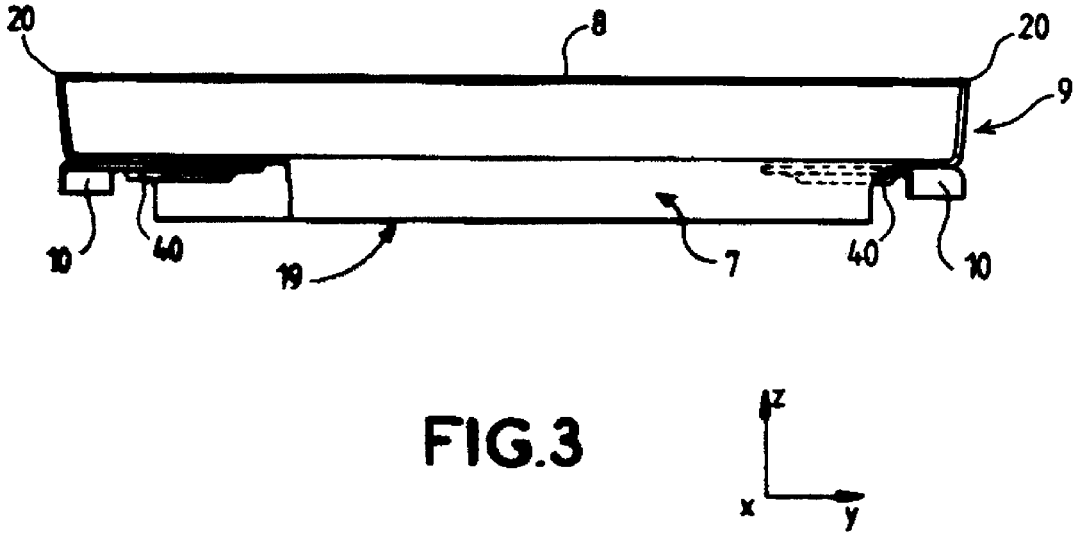
FIG. 3 illustrates in partially exploded side view, a frame/mask according to the invention.

In the embodiment illustrated in FIGS. 2, 3, 4, the frame 19 of 16×9 format CRT comprises a pair of long sides 9 and a pair of short sides 7. The long side 9 having a flat part 37 and short sides 7 having an other flat part 39, wherein the flat parts 37, 39 are substantially parallel to the surface of the mask which the frame 19 is designed to hold it under tension. The mask 8 is held under tension by welding on the ends 20 of the long sides 9 of the frame 19.

The result is that the mechanical tension of the mask 8 is held by the short sides 7 which must therefore have sufficient rigidity.

It is known that during tube manufacturing that the frame/mask assembly undergoes heat treatment at temperatures of about 450° C. However, because of its low mass, the mask 8 behaves mechanically in a different manner to the frame 19 during manufacture processing. For example, after the oxidation step when the frame/mask assembly is brought back to room temperature, the mask 8 which has a very low thermal inertia with respect to the frame will cool faster than the frame 19. Therefore, during the transient cooling phase of the frame 19, the tension of the mask 8 will be much greater than when the two elements have reached the same temperature. Depending on the tension applied initially to the mask and on the type of material forming the mask 8, the frame 19 may be taken beyond its elastic limit during these transient phases and a permanent deformation, making its subsequent use impossible, will follow. This increase under tension may also cause twisting of the frame depending on the distribution of the mechanical stresses, if these stresses are not distributed in a completely homogenous manner.

The required rigidity is therefore obtained at present by oversizing the sections of the sides of the frame 19 to obtain the tension that short sides 7 are designed to hold.

The study of stresses exerted on such a frame 19, supporting a mask 8 put under tension, has made it possible to demonstrate that the highest mechanical stresses would be exerted in the regions close to the comers of the frame 19.

According to the invention, it is possible to use a frame 19 which is especially light and have low-thickness profiles with respect to the state of the art frame 21. The frame of the current inventions can be lighter and yet maintain mechanical rigidity by the addition of support parts 10 serving as reinforcement where necessary, which is to say along the short sides 10 closest to the corners of the frame 19. These support parts 10 comprise a dimple 40 lying longitudinally in the direction of tension of the mask over a length covering the region of the frame 19 where calculations show that the highest mechanical stresses are exerted on the frame 19 during the high-temperature steps of the manufacturing. This dimple can be formed by stamping the reinforcing part (i.e., the would-be support part 10) in its central region, thereby creating edges 41, 42 which will come in contact with the surface of the frame 19 and act as a region for fastening, for example, by welding, the resultant support part 10 to the frame 10. The dimple 40 considerably increases the rigidity of the support part 10 and makes it possible to decrease the thickness of the profile forming the sides of the frame 19, thereby eliminating the need for the added materials that a comparable state of the art frame 21 would otherwise require in the absence of the support part 10 with the dimple 40.

In the exemplary embodiment of FIGS. 2, 3, and 4, the frame 19 made on Invar and having a diagonal dimension of 76 cm would require a thickness of material of about 1.5 mm when the support parts 10 are placed close to the four corners of the frame 19 and has a component segment of length 14 lying on one of the surfaces of the flat part 37 of the frame 19 to which the component segment is fastened, for example, by welding. These support parts 10 can be made of Invar and have a thickness identical to that of the frame 19. The component segment can each have a length 14 of about 6 cm and therefore cover about 25% of each of the short sides 7.

Figure 5:
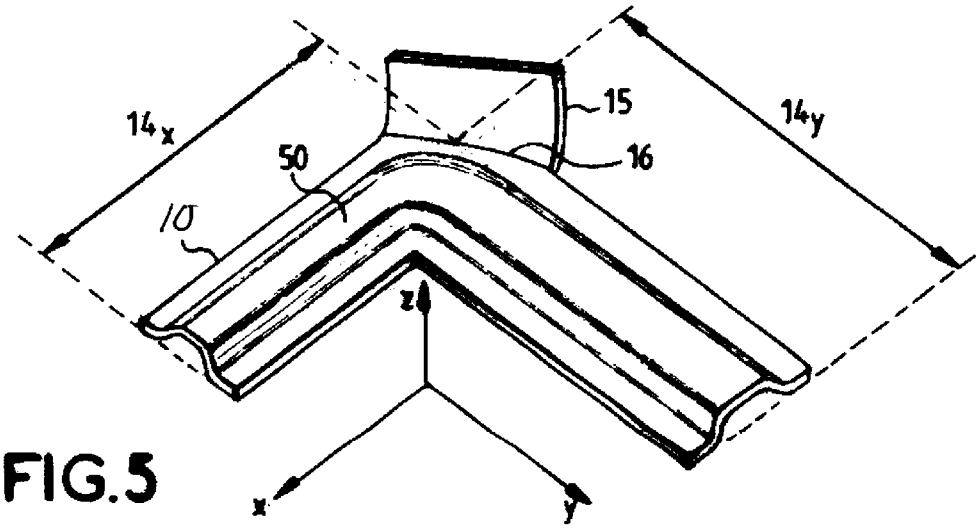
FIG. 5 illustrates a second embodiment of the invention.

For tubes with a large screen size, for example, with a diagonal dimension greater than 70 cm, it is advantageous to use support parts 10' as illustrated in FIG. 5. Calculations in fact show that the mechanical stresses generated on the frame by a high temperature are also exerted close to the corners thereof for systems where the mask 8 is welded to the long sides 9 while under tension. The support part 10 is then L-shaped with a support enhancing dimple 50 lying in the direction of tension of the mask along a vertical length 14*y* and in the direction perpendicular to the direction of tension along a horizontal length 14*x*. Stress analysis of the frame during the high temperature steps shows that the maximum value of these stresses in the horizontal direction X is located closer to the comers of the frame than the maximum value of these stresses in the vertical direction Y. This results in a greater length of support enhancing dimple 50 in the vertical direction Y than in the horizontal direction X.

In addition, the invention has other technical advantages. The support parts 10, as illustrated in FIGS. 2, 3, 4, and 5 may provide a support for the frame/mask assembly by ensuring that the support part 10 comprises a second part 15 which after folding around an intermediate region 16 will be in a direction essentially perpendicular to the surface of the mask 8. Conventionally, it is possible to weld to the second part 15 to a spring 11 which has an aperture designed to surround a pin 12 attached to the skirt 3 of the panel 2 of the tube 1. In this way, it is possible to decrease the number of metal parts used, since the support parts 10 participate in the mechanical reinforcement of the short sides 7 of the frame 19 and provide a support for the frame/mask assembly.

The support part 10 can be used to provide a solution to the heat transient problem when putting the tube 1 into service. For this, the support part 10 are made from a material having a thermal expansion coefficient different from that of the frame 19 such that these component collectively maintain the purity of the individual colors during normal operation. As described in U.S. Pat. No. 4,827,180, on illumination of the tube, there is a period of heating the frame/mask assembly which could cause discoloration of the image formed on the tube screen. This discoloration is due to the fact that during the heat transient, with the frame expanding gradually, for example, along the horizontal axis, it is necessary to give the mask 8 a slight movement in the direction of the screen so that the electron beams illuminate the corresponding phosphor lines. The temperature increases are much lower than those recorded (in this case they are of the order of a few tens of degrees with respect to the ambient temperature) during the steps of the tube manufacturing process, but enough to lead to a loss of color purity on the tube screen 13. To alleviate this effect, the support parts 10 are chosen for example to be made of N42 iron/nickel alloy having a thermal expansion coefficient which is three times greater than that of Invar, when the frame 19 itself is made of Invar and the length 14 of the support part 10 is welded onto the short sides 7 of the frame 19 on the surface of the flat part 37 opposite the surface of the mask 8. In this way, the frame/mask assembly is displaced with respect to the screen 13 during the heat transient and the curvature of the short sides 7 of the frame 19 is caused by the difference in expansion of the support parts 10 and the short sides 9 will come towards the mask 8.

In another embodiment (not shown), the frame having long sides 9 with an L-shaped section, some edge substantially parallel to the surface of the mask, some other edge perpendicular to this surface and to which the mask is attached, wherein the frame/mask assembly is supported in the corners by some support means having of parts comprising a longitudinal dimple and placed close to the comers of the frame on the sides of the frame perpendicular to the surface of the mask 8.

What is claimed is:

1. A color cathode-ray tube having a glass front face on which a phosphor screen is deposited, a color selection mask placed close to the screen, a frame to which the mask is attached and which holds the mask under tension in at least one direction, the frame being of substantially rectangular shape defined by a pair of opposed long sides and a pair of short sides which are also opposed, the frame/mask assembly being held inside the front face by support means comprising:

at least two opposed sides of the frame comprise mechanical reinforcing means in the form of a metal plate fastened to the sides, close to the comers of the frame, the plates comprising a longitudinal dimple lying at least partially in the direction of tension of the mask.

2. The cathode-ray tube according to claim 1 further comprises the direction of tension of the mask being parallel to the short sides of the frame and the reinforcing means being placed on the short sides.

3. The cathode-ray tube according to claim 1 further comprising the support means being placed at the corners of the frame and being L-shaped.

4. The cathode-ray tube according to claim 3 further comprising the support means having two parts, the dimple lying along the two parts, and the vertical length of the dimple in the direction of tension of the mask being greater than the horizontal length of the dimple in the perpendicular direction.

5. The cathode-ray tube according to claim 4 further comprising:

the support means each including a first part lying over a surface of the frame along a length, the support being fastened to the frame, by welding, and a second part lying in a direction substantially perpendicular to the surface of the mask.

6. The cathode-ray tube according to claim 1 further comprising the thermal expansion coefficients of the material forming the frame and the support means being different.

7. The cathode-ray tube according to claim 6 further comprising the thermal expansion coefficient of the support means being greater than that of the sides of the frame to which the support means is welded.

* * * * *